US005445387A

United States Patent [19]

Maruko et al.

[11] Patent Number: 5,445,387

[45] Date of Patent: Aug. 29, 1995

[54] THREAD-WOUND GOLF BALL

[75] Inventors: Takashi Maruko, Yokohama; Toshio Chikaraishi, Akishima, both of Japan

[73] Assignee: Bridgestone Sports, Co., Ltd. of 45, Tokyo, Japan

[21] Appl. No.: 168,145

[22] Filed: Dec. 17, 1993

[30] Foreign Application Priority Data

Dec. 21, 1992 [JP] Japan ..... 4-356342

[51] Int. Cl.[6] ..... A63B 37/06

[52] U.S. Cl. ..... 273/216; 273/225; 273/230

[58] Field of Search ..... 273/226, 227, 218, 230, 273/216, 225, 222

[56] References Cited

U.S. PATENT DOCUMENTS

| | | | |
|---|---|---|---|
| 1,080,592 | 12/1913 | Saunders | 273/227 |
| 4,570,937 | 2/1986 | Yamada | 273/218 X |
| 4,650,193 | 3/1987 | Molitor et al. | 273/230 X |
| 5,184,828 | 2/1993 | Kim et al. | 273/228 |

FOREIGN PATENT DOCUMENTS 60-168852 11/1985 Japan .

*Primary Examiner*—George J. Marlo
*Attorney, Agent, or Firm*—Sughrue, Mion, Zinn, Macpeak & Seas

[57] ABSTRACT

In a thread-wound golf ball comprising a solid center, a thread rubber layer and a cover, the solid center has a single structure and is continuously increased in hardness from its center to its outer surface such that the difference in hardness between the center and 2 mm inside the outer surface is at least about 4 in JIS C scale hardness. The ball is improved in hitting feel.

5 Claims, 2 Drawing Sheets

THREAD-WOUND GOLF BALL

BACKGROUND OF THE INVENTION

1. Field of the Invention

This invention relates to a thread-wound golf ball comprising a center ball or solid center, a thread rubber layer and a cover.

2. Prior Art

Thread-wound golf balls which have been used are of the structure shown in FIG. 1 which is generally prepared by winding rubber thread around the outer surface of a center ball 1 to form a thread rubber layer 2 and forming a cover 3 thereon. The center ball 1 may be either a solid center consisting of a hard rubber ball or a liquid center having liquid introduced into a hollow rubber ball under pressure.

Prior art thread-wound golf balls using a solid center have the advantages of good temperature dependency of repulsion meaning that repulsion is scarcely changed at a low temperature as compared with golf balls having a liquid center, and low cost. But the disadvantage is inferior feel as compared with thread-wound golf balls using a liquid center. There is a desire to improve the hitting feel of thread-wound golf balls using a solid center.

Japanese Utility Model Application Kokai No. 168852/1985 discloses a solid center of a double structure for providing an improved feel. Since the solid center has a complicated structure, the manufacture of this ball involves an extra step which eliminates the low cost feature associated with the use of a solid center. In addition, since the center ball has a discontinuous hardness boundary, the ball is undesirably less durable.

SUMMARY OF THE INVENTION

Therefore, an object of the present invention is to provide a thread-wound golf ball which is improved in feel without detracting from the advantages of a solid center.

The present invention is concerned with a thread wound golf ball comprising a generally spherical solid center, a thread rubber layer enclosing the center, and cover thereon. We have found that the ball is improved in feel by using a rubber ball of a single structure as the solid center and constructing the single structure rubber ball such that hardness is gradually increased in a radially outward direction from the center.

According to the present invention, there is provided a thread-wound golf ball of the above-mentioned type wherein the solid center has a single structure having a center portion and an outer surface portion and is gradually increased in hardness from the center portion to the outer surface portion. The difference in hardness between the center and 2 mm inside the outer surface is at least 4 in JIS C scale hardness.

Since the solid center is of a single structure in which the desired hardness change is achieved simply by selecting rubber crosslinking conditions, it can be manufactured at a low cost without an extra step. Particularly, by selecting as a crosslinking agent an organic peroxide having a low 1-min half-life temperature, the solid center can be easily obtained which is hard outside and soft inside. The continuous hardness change and the absence of a boundary ensure durability. The golf ball using such a solid center of the structure which is hard outside and soft inside is improved in feel and reduced in spin. Therefore, irrespective of a solid center, there is achieved solid center ball performance involving the characteristics of a liquid center.

DETAILED DESCRIPTION OF THE INVENTION

Figure 1:
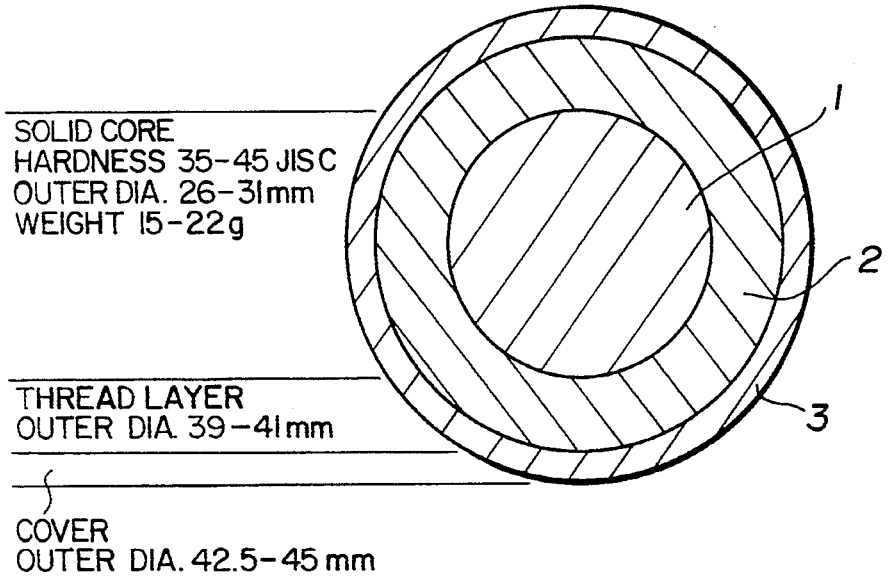
FIG. 1 is a schematic cross section of a thread-wound golf ball.

Referring to FIG. 1, the thread-wound golf ball of the invention includes a generally spherical solid center 1 having a center portion and an outer surface portion, a thread rubber layer 2 enclosing the outer surface of the center 1, and a cover 3 enclosing the layer 2.

According to the invention, the solid center has a single structure which is hard outside and soft inside, that is, continuously increased in hardness from the center portion to the outer surface portion. The difference in hardness between the center and a position spaced radially inside 2 mm from the outer surface is at least 4, preferably 4 to 9, more preferably 5 to 7, in JIS C scale hardness.

Desirably the solid center has a hardness of 35 to 45 to JIS C scale at its center portion and an outer diameter of 26 to 31 mm The weight of the solid center is preferably 15 to 22 g.

The solid center of the above-mentioned structure can be prepared by appropriately selecting the formulation and curing conditions of a rubber composition. More particularly, the solid center may be formed from a rubber composition comprising 100 parts by weight of a rubber component such as high cis-poly-butadiene, 5 to 15 parts by weight of a crosslinking agent such as zinc acrylate or zinc methacrylate, 0.5 to 2 parts by weight of a dispersant such as stearic acid, and 5 to 10 parts by weight of an antiaging agent such as zinc oxide, and 80 to 180 parts by weight of a weight controlling agent such as barium sulfate. The crosslinking agent which is selected from organic peroxides having a 1-min half-life temperature of lower than 150° C., preferably 130° to 148° C., for example, 1,1-bis(tert-butylperoxy)-3,3,5-trimethyl cyclohexane (Perhexa 3M) and benzoyl peroxide. The 1-min half-life temperature is a temperature providing a half life of one minute. Then the composition is heated to a temperature at least 10° to 20° C. higher than the half-life temperature, for example, about 160° to 170° C. in case of 1,1-bis(tert-butylperoxy)-3,3,5-trimethyl cyclohexane or about 140° to 150° C. in case of benzoyl peroxide for about 15 to 20 minutes for crosslinking to occur. In this way, the solid center of a desired hardness varying structure is obtained.

The thread rubber layer formed over the solid center may be one used in conventional thread-wound golf balls and the cover may be formed from conventional cover materials such as balata and ionomer resins. The diameter of the solid center is preferably 26 to 31 mm, more preferably about 30 mm, the diameter of the thread-wound core obtained by winding the thread rubber to the solid center is preferably 39 to 41 mm, more preferably about 40 mm, and the diameter of the resulting golf ball is preferably 42.5 to 45 mm, more preferably 42.5 to 44 mm, most preferably 42.67.

The thread-wound golf ball of the invention has eliminated the disadvantage of solid center type balls, that is, is improved in feel.

EXAMPLE

Examples of the present invention are given below by way of illustration and not by way of limitation.

EXAMPLE

A solid center having a diameter of 28 mm was prepared from a rubber composition of the following composition by molding and vulcanizing it at 160° to 170° C. for 15 to 20 minutes.

| Solid center-forming rubber composition | |
|---|---|
| | Part by weight |
| High cis-polybutadiene | 100 |
| Zinc acrylate | 10 |
| Perhexa 3M | 3 |
| Stearic acid | 1 |
| ZnO | 10 |
| $BaSO_4$ | 140 |

A large-size thread-wound golf ball having a diameter of 42.67 mm was fabricated by winding thread rubber around the solid center to form a thread rubber layer and forming thereon a cover of 2 mm thick in a conventional manner.

COMPARATIVE EXAMPLE

A solid center was prepared from a rubber composition of the same formulation except that the Perhexa 3M was replaced by Percumyl D (dicumyl peroxide) by molding and vulcanizing it at 155° C. for 15 minutes. Following the procedure of Example, a thread-wound golf ball was fabricated.

Figure 2:
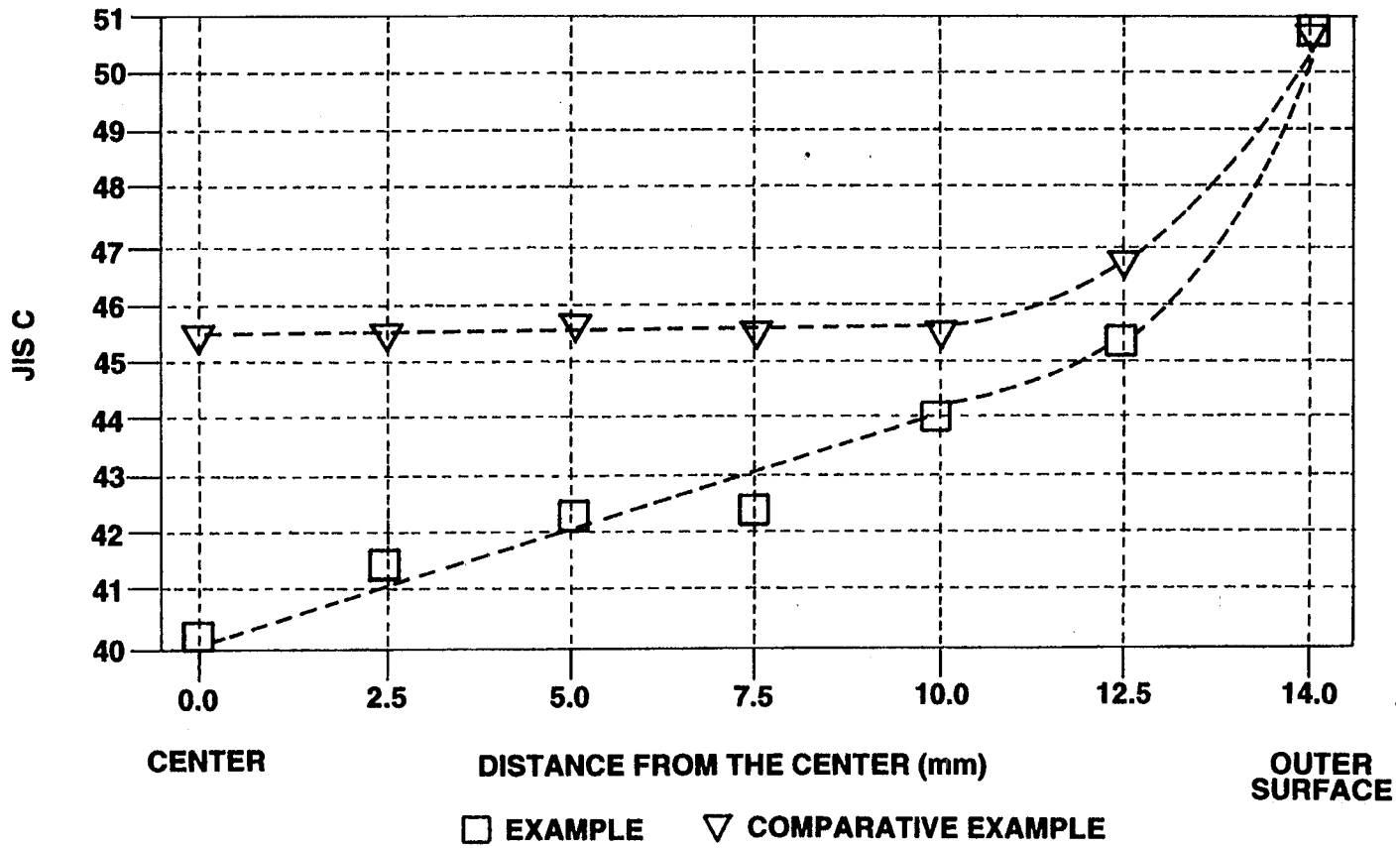
FIG. 2 is a diagram showing the hardness distribution in a cross section of inventive and comparative golf balls.

The solid centers of Example and Comparative Example were cut into halves by means of a cutter. Using a JIS C hardness meter, hardness was measured at intervals along a radius of the section. The results are shown in FIG. 2 wherein hardness (JIS C scale) is plotted relative to a distance (mm) from the center.

The golf balls of Example and Comparative Example were evaluated for hitting feel and durability.

In an actual hitting test, the golf ball of Example presented an approximate feel to that of a thread-wound golf ball using a liquid center and was significantly superior to the ball of Comparative Example. No difference in durability was found between Example and Comparative Example. That is, the golf ball of Example had durability equal to that of a thread-wound golf ball using a conventional solid center.

Although some preferred embodiments have been described, many modifications and variations may be made thereto in the light of the above teachings. It is therefore to be understood that within the scope of the appended claims, the invention may be practiced otherwise than as specifically described.

We claim:

1. A thread-wound golf ball comprising; a generally spherical solid center, a thread rubber layer enclosing the center, and a cover thereon, wherein:

said solid center has a single structure having a center portion and an outer surface portion and is gradually increased in hardness from the center portion to the outer surface portion, the difference in hardness between the center and 2 mm inside the outer surface being at least 4 in JIS C scale hardness, said solid center at the center has a hardness of 35 to 45 on JIS C scale.

2. The thread-wound golf ball of claim 1 wherein said solid center has an outer diameter of 26 to 31 mm and a weight of 15 to 22 grams.

3. The thread-wound golf ball of claim 1, wherein the outer diameter of said thread rubber layer enclosing the center is in the range of 39–41 mm.

4. The thread-wound golf ball of claim 1, wherein said difference in hardness is in the range of 4–9 in JIS C hardness.

5. The thread-wound golf ball of claim 1, wherein said cover is 2 mm in thickness.

* * * * *